US011289808B2

(12) United States Patent
Holzheimer et al.

(10) Patent No.: US 11,289,808 B2
(45) Date of Patent: Mar. 29, 2022

(54) TUNABLE APERTURE FOR MULTIPLE SPECTRUMS

(71) Applicant: Raytheon Company, Waltham, MA (US)

(72) Inventors: Timothy R. Holzheimer, Rockwall, TX (US); Ricardo H. Paredes, Buellton, CA (US)

(73) Assignee: Raytheon Company, Waltham, MA (US)

( * ) Notice: Subject to any disclaimer, the term of this patent is extended or adjusted under 35 U.S.C. 154(b) by 152 days.

(21) Appl. No.: 16/661,333

(22) Filed: Oct. 23, 2019

(65) Prior Publication Data

US 2021/0126364 A1 Apr. 29, 2021

(51) Int. Cl.

| | |
|---|---|
| ***H01Q 5/22*** | (2015.01) |
| ***H01Q 1/48*** | (2006.01) |
| ***H01Q 9/14*** | (2006.01) |
| ***H01Q 23/00*** | (2006.01) |
| ***H01Q 21/26*** | (2006.01) |
| ***H01Q 9/28*** | (2006.01) |
| ***H01Q 1/36*** | (2006.01) |

(52) U.S. Cl.

CPC ..... *H01Q 5/22* (2015.01); *H01Q 1/364* (2013.01); *H01Q 1/48* (2013.01); *H01Q 9/145* (2013.01); *H01Q 9/28* (2013.01); *H01Q 21/26* (2013.01); *H01Q 23/00* (2013.01)

(58) Field of Classification Search

CPC ..... H01Q 1/06; H01Q 1/364; H01Q 1/48; H01Q 5/22; H01Q 5/30; H01Q 5/307; H01Q 5/314; H01Q 5/321; H01Q 5/50; H01Q 9/14; H01Q 9/145; H01Q 9/16–46; H01Q 23/00

See application file for complete search history.

(56) References Cited

U.S. PATENT DOCUMENTS

| | | | | |
|---|---|---|---|---|
| 5,432,374 | A | 7/1995 | Norton | |
| 6,208,293 | B1 | 3/2001 | Adams et al. | |
| 6,271,802 | B1 * | 8/2001 | Clark | G01J 5/0837 343/895 |
| 6,310,346 | B1 * | 10/2001 | Boreman | G01J 5/08 250/338.1 |
| 6,329,649 | B1 * | 12/2001 | Jack | G01J 5/20 250/250 |
| 6,417,807 | B1 * | 7/2002 | Hsu | H01Q 1/38 333/262 |

(Continued)

OTHER PUBLICATIONS

Liu et al., "Structurally Embedded Photoconductive Silicon Bowtie Antenna;" IEEE Photonics Technology Letters, vol. 10, No. 5; May 1998; 3 Pages.

(Continued)

*Primary Examiner* — Ricardo I Magallanes

(74) *Attorney, Agent, or Firm* — Daly Crowley Mofford & Durkee, LLP

(57) ABSTRACT

Methods and apparatus for a tunable dual spectrum antenna aperture including a RF antenna having first and second portions, wherein the first portion comprises a photoconductor material having a conductive state and a non-conductive state, and an IR sensor to detect IR energy. The state of the first portion determines a size of the RF antenna.

13 Claims, 7 Drawing Sheets

(56) References Cited

U.S. PATENT DOCUMENTS

| | | | | |
|---|---|---|---|---|
| 6,831,604 | B2 * | 12/2004 | Obara | H01Q 21/065 343/700 MS |
| 10,175,349 | B1 * | 1/2019 | Ternovskiy | G01S 7/03 |
| 10,186,771 | B2 | 1/2019 | Bowden et al. | |
| 2018/0284222 | A1 * | 10/2018 | Garrec | G06T 1/0007 |
| 2020/0027663 | A1 * | 1/2020 | Seong | H01G 7/00 |
| 2021/0028534 | A1 * | 1/2021 | Liu | H01L 23/66 |
| 2021/0057594 | A1 * | 2/2021 | Nguyen | H01Q 19/062 |

OTHER PUBLICATIONS

Nahar et al., "Ultra Wideband Transparent RF Aperture for Electro-Optical Integration;" Proceedings of the 2010 IEEE Antennas and Propagation Society International Symposium; Jul. 11, 2010; 4 Pages.

VanBlaricum, "Photonic Antenna Reconfiguration: A Status Survey;" Proceedings of the SPIE, Photonics and Radio Frequency II; Jul. 21, 1998; pp. 180-189; 10 Pages.

* cited by examiner

TUNABLE APERTURE FOR MULTIPLE SPECTRUMS

BACKGROUND

Photo-conductive antennas activated by laser pulses (or continuous wave (CW) laser light) may include antenna elements fabricated from a photo-conductive semiconductor material that becomes conductive when illuminated by a light source. When the laser source is turned off, the photo-conductive antenna elements become non-conductive. In the non-conductive state the antenna elements cannot transmit or receive electromagnetic waves. Light may be fed to such antennas by arrays of optical fibers, which may be cumbersome. Moreover, such an antenna may have little flexibility to accommodate different frequencies of operation.

SUMMARY

Embodiments of the invention provide method and apparatus for an optically controlled aperture to receive energy in a first frequency band, such as RF, and a second frequency band, such as infrared, to provide a multi-spectrum aperture. In embodiments, a first transducer, such as an RF antenna, is tunable in frequency, such as by using a PIC (photonic integrated circuit). In some embodiments, the RF antenna is tunable across about a 2 GHz to about a 18 GHz bandwidth and a further transducer, such as a focal plane array (FPA), covers at least one infrared band (e.g., SWIR, MWIR, LWIR).

In embodiments, the aperture includes an RF antenna with at least one material that is conductive in a first state and non-conductive in a second state that allows adjustment of the size of the RF antenna. In embodiments, the tunable RF portion of the aperture uses an integrated laser and grating to uniformly illuminate the photoconductive material when turned on, which causes the photoconductive material to become conductive. The photoconductive material couples to a center element structure to change the frequency range of operation of the RF portion of the aperture without impacting the infrared portion of the aperture. This provides a simultaneously tunable RF channel integrated with an infrared channel in the same compact size, weight and power (SWAP) space.

Aperture embodiments are useful in a wide range of applications in which it is desirable to receive signals in multiple spectrums, such as radars, satellites, vehicles, ships, propelled projectiles, UAVs (unmanned aerial vehicles), electronic support measures (ESM), signals intelligence (SIGINT) (communications intelligence (COMINT) and electronic intelligence (ELINT)), radar warning receiver (RWR) systems and low radar cross section (RCS) items.

In embodiments, the RF antenna can include a crossed dipole antenna with a size determined by the length of a pair of dipole arms that are made conductive. The highest operating frequency may be defined by the size of the metal conductors of the RF antenna where the infrared sensor is merged to the lowest frequency being limited by how many segments are added and illuminated for each dipole arm. A metallic center section may allow for transmit capability via hard RF transmission line connections.

In embodiments, a suitable IR sensor can be used, such as a MWIR detector approximately one-inch square comprising 2 k by 2 k detectors. The IR sensor can include Cadmium-Zinc-Telluride substrate that is a conductive material be placed over the conductive center part of the RF aperture that is conductive. In embodiments, four MWIR detectors can be placed on the aperture for higher resolution applications.

In one aspect, a system comprises: an antenna aperture comprising: an RF antenna having first and second portions, wherein the first portion comprises a photoconductor material having a conductive state and a non-conductive state; and an IR sensor to detect IR energy.

A system can further include one or more of the following features: a PIC (photonic integrated circuit) for tuning the RF antenna by selecting the conductive state or the non-conductive state of the first portion of the RF antenna, the PIC comprises a laser to selectively illuminate the first portion of the RF antenna and select the conductive state, the PIC controls a size of the aperture by selecting the conductive state or the non-conductive state of the first portion of the RF antenna, the RF antenna comprises a frequency range of at least about 0.5 GHz to about 18 GHz, the IR sensor is coincident with the RF antenna, the IR sensor comprises a microbolometer, the IR sensor comprises a focal plane array (FPA), the IR sensor comprises a MWIR sensor, the IR sensor comprises a SWIR sensor, a MWIR sensor, and a LWIR sensor, the IR sensor is located between antenna elements of the RF antenna, a ground plane, wherein the IR sensor is located on the ground plane, a feed line from the RF antenna to the ground plane, the aperture has a lower radar cross section when the first portion is in the non-conductive state, the second portion comprises a metal material, the second portion comprises a photoconductive material, and/or a PIC (photonic integrated circuit) adhered to a substrate supporting the RF antenna, wherein the PIC comprises at least one laser and at least one waveguide for tuning the RF antenna by selecting the conductive state or the non-conductive state of the first portion of the RF antenna.

In another aspect, a method comprises: in an antenna aperture, controlling a conductive state of a photoconductive material for tuning an RF antenna, wherein the RF antenna includes first and second portions, wherein the first portion comprises the photoconductor material; and employing an IR sensor to detect IR energy.

A method can further include one or more of the following features: a PIC (photonic integrated circuit) for tuning the RF antenna by selecting the conductive state or the non-conductive state of the first portion of the RF antenna, the PIC comprises a laser to selectively illuminate the first portion of the RF antenna and select the conductive state, the PIC controls a size of the aperture by selecting the conductive state or the non-conductive state of the first portion of the RF antenna, the RF antenna comprises a frequency range of at least about 0.5 GHz to about 18 GHz, the IR sensor is coincident with the RF antenna, the IR sensor comprises a microbolometer, the IR sensor comprises a focal plane array (FPA), the IR sensor comprises a MWIR sensor, the IR sensor comprises a SWIR sensor, a MWIR sensor, and a LWIR sensor, the IR sensor is located between antenna elements of the RF antenna, a ground plane, wherein the IR sensor is located on the ground plane, a feed line from the RF antenna to the ground plane, the aperture has a lower radar cross section when the first portion is in the non-conductive state, the second portion comprises a metal material, the second portion comprises a photoconductive material, and/or a PIC (photonic integrated circuit) adhered to a substrate supporting the RF antenna, wherein the PIC comprises at least one laser and at least one waveguide for tuning the RF antenna by selecting the conductive state or the non-conductive state of the first portion of the RF antenna.

BRIEF DESCRIPTION OF THE DRAWINGS

The foregoing features of this invention, as well as the invention itself, may be more fully understood from the following description of the drawings in which.

DETAILED DESCRIPTION

Figure 1:
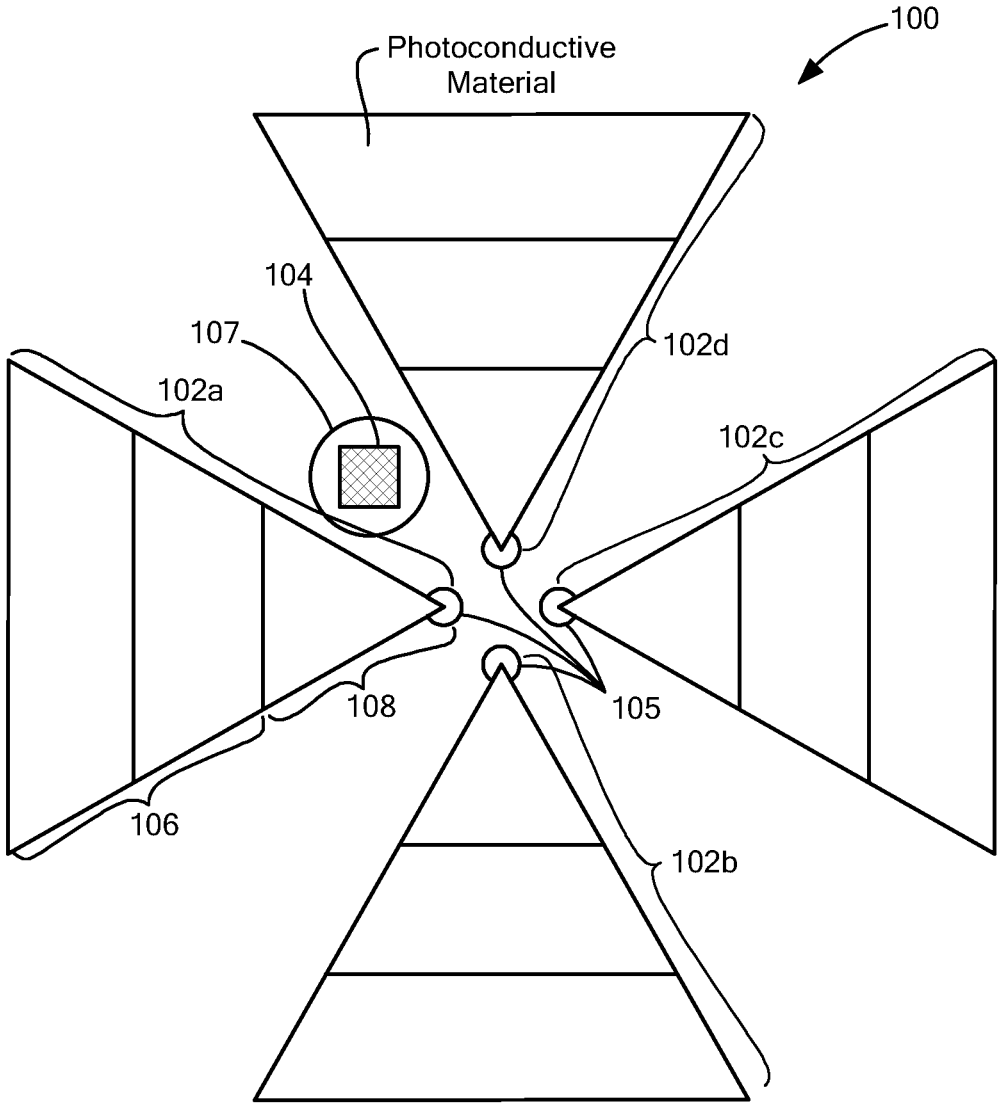
FIG. 1 is a top view of a dual spectrum tunable antenna aperture.

FIG. 1 shows a sensor system 100 having a first transducer, such as a first antenna 102, which is RF-tunable, and a second transducer 104, which covers a given frequency band, such as one or more IR bands, where the given frequency band differs from a frequency band of the first antenna. In embodiments, the first and second transducers 102, 104 are coincident. In embodiments, the RF antenna 102 comprises one or more antenna elements 102*a-d*. In the illustrated embodiment, the first antenna 102 comprises a pair of so-called bowtie antennas. The elements of the first antenna 102 can be coupled to a substrate via feed connections 105.

In embodiments, a first RF antenna element 102*a* comprises a first portion 106 that includes at least one selectively conductive portion and a second portion 108 that is conductive. In embodiments, the first portion 106 comprises a photoconductive material and the second portion 108 comprises a metallic material, such as copper.

While example embodiments refer to an aperture having a RF antenna and an IR antenna/sensor, is understood that multi-spectrum aperture embodiments include antennas for a first frequency range and a second frequency range, one or both of which may be outside of, or overlap only partly with, RF and/or IR frequency bands. In addition, the first and second frequency ranges may overlap.

It is understood that any suitable RF antenna type having any practical number of antenna elements can be used to meet the needs of a particular application. It will be appreciated that the illustrated bowtie antenna is an illustrative embodiment of one particular RF antenna configuration.

The first portion 106 may comprise a photoconductor material, e.g., a semiconductor material that may act as an insulator when not illuminated, and that may act as a conductor when illuminated with light having a photon energy greater than the band gap of the semiconductor material. Such a material may act as a conductor as a result of absorbed photons creating electron-hole pairs in the semiconductor material, the electrons and/or holes then being capable of carrying current through the material. A laser may act as a light source, to cause the first portion 106 to become conductive when the laser illuminates the photoconductive material, and to be nonconductive otherwise. The laser may produce pulsed light or continuous wave (CW) light. Illumination of the first portion 106 of the first antenna 102 is shown and described more fully below.

It is understood that any suitable material can be used that has a conductive state and a non-conductive state where the states are controllable by the selective application of energy. The use of a laser to apply laser light to a photoconductive material is an example embodiment. Other materials may be conductive upon the application of any type of energy that is effective to alter the conductivity of the material. It is understood that the bandgap of the material determines what laser wavelength to use. It should be noted that the 1310 nm range does not need cooling with a thermoelectric cooler, for example.

Figure 1A:
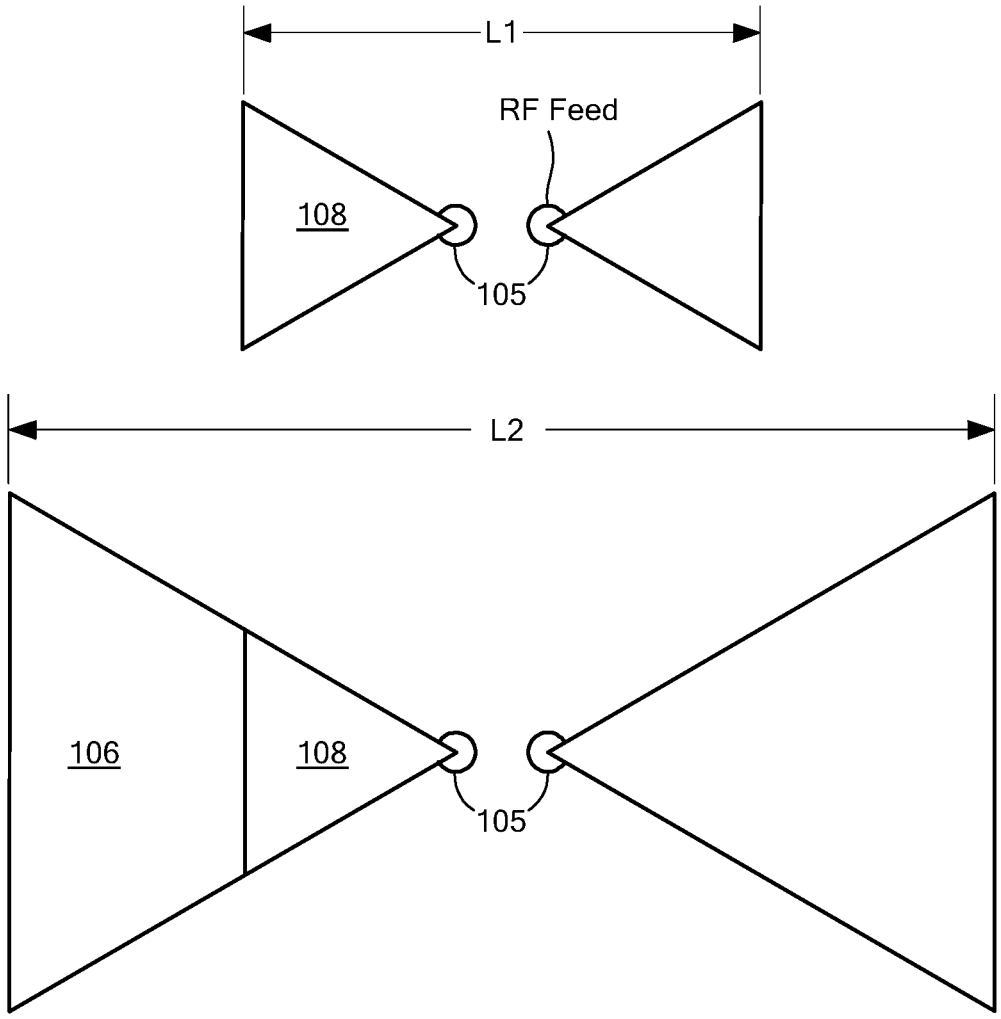
FIG. 1A is a top view showing a RF antenna having first and second sizes.

As shown in FIG. 1A, the size of the aperture of the first antenna 102 changes depending upon whether the first portion 106 is conductive or non-conductive. As can be seen, the first antenna 102 has a size L1 when the first portion 106 is non-conductive and size L2 when the first portion 106 is conductive. In embodiments, a copper dipole antenna provides about seventy percent bandwidth frequency operation per change in length, which corresponds to a typical bandwidth from a metal dipole antenna with triangular shaped elements. In embodiments, the first antenna 102 can comprise any practical number of independent selectively conductive portions.

In some embodiments, the first antenna 102 comprises first and second antenna portions 106 and 108 each of which comprises a photoconductive material. Each of the first and second portions 106 and 108 of the first antenna 102 can be independently controlled by respective lasers, for example.

Figure 1B:
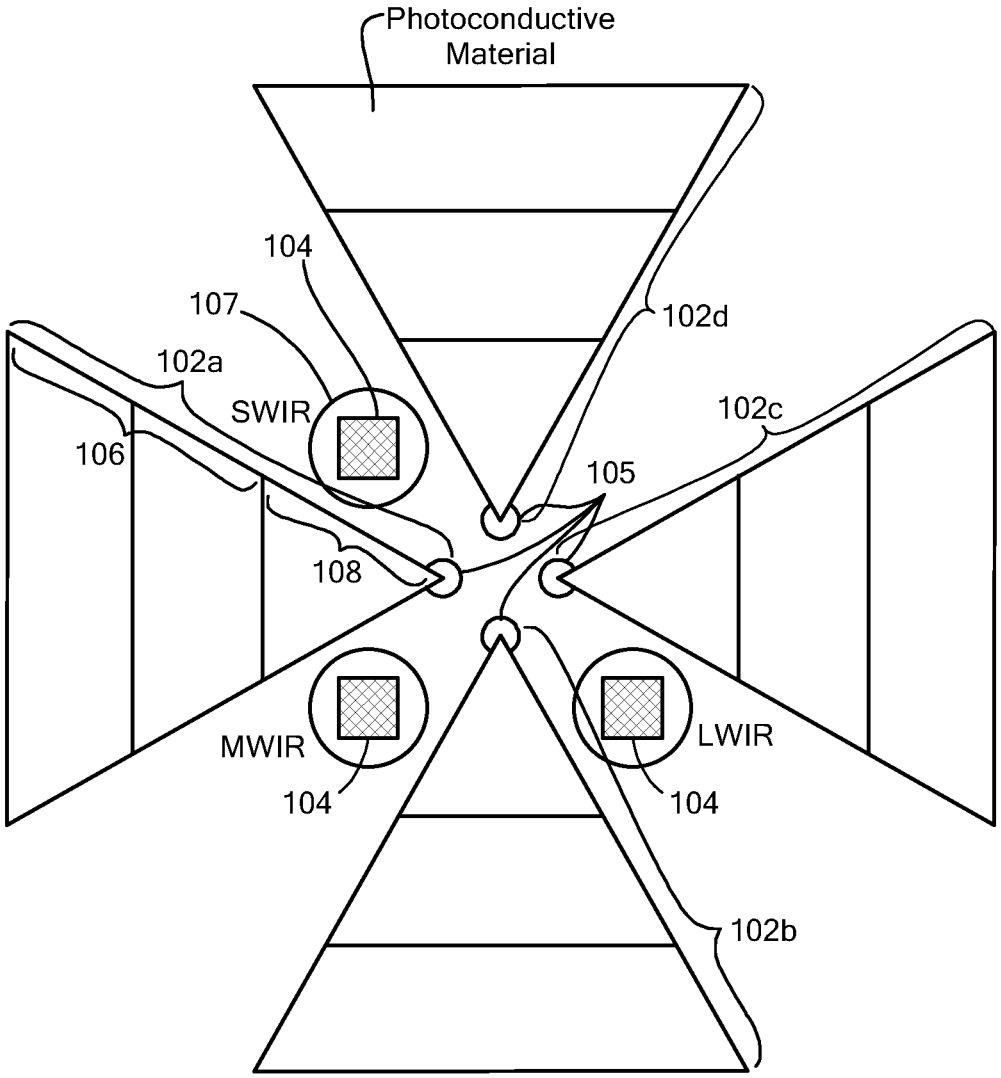
FIG. 1B is a top view showing the aperture of FIG. 1 with additional IR sensors.

The second transducer/sensor 104 can include a lens 107 to focus received energy on a focal plane array (FPA), for example. FPAs are well-suited as IR sensors. As shown in FIG. 1B, the IR sensor 104 can include a number of sensors each having a different frequency band. In the illustrated embodiment, the IR sensor 104 includes sensors for SWIR (short wave infrared), MWIR (medium wave infrared), and LWIR (long wave infrared).

In embodiments, FPAs can be cooled, such as by using thermoelectric coolers and/or liquid nitrogen stirling coolers. In embodiments, FPAs may be placed on an element ground plane (e.g., 308 in FIG. 3) with lenses on the element top layer focusing the IR energy on to the FPAs.

Figure 2:
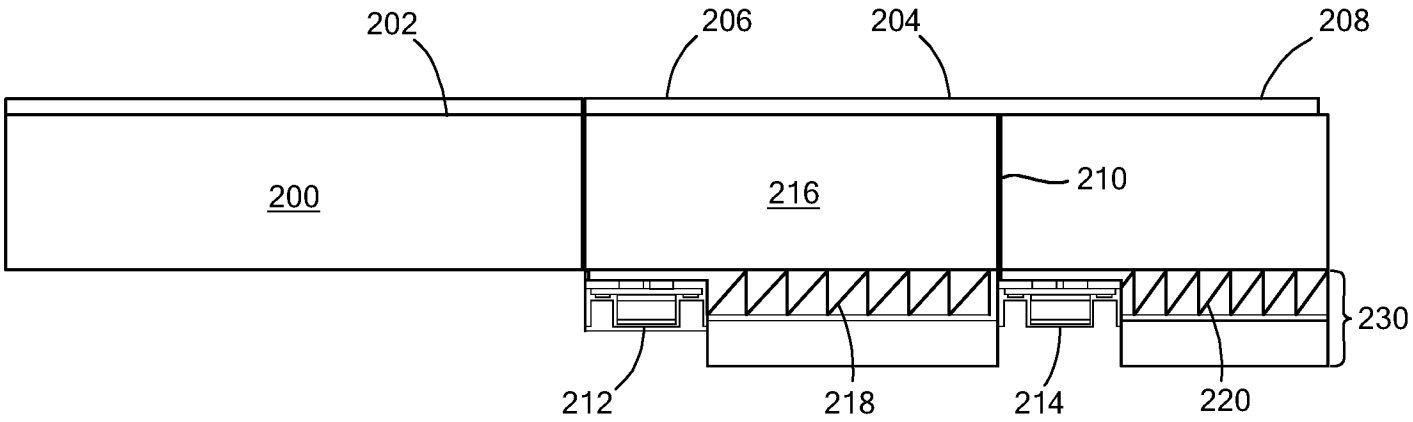
FIG. 2 is a cross sectional view of a portion of a dual spectrum tunable antenna system.

FIG. 2 shows further detail for controlling a conductive state of a photoconductive material, such as the first portion 106 of the first antenna 102 of FIG. 1. A substrate 200, such as SiO2, includes a conductive material 202, such as copper, which can correspond to the second portion 108 of FIG. 1, and a photoconductive material 204, which can correspond to the first portion 106.

The photoconductive material 204 may comprise a semiconductor material that may act as an insulator when not illuminated and may act as a conductor when illuminated with light having a photon energy greater than the band gap of the semiconductor material. The photoconductive material 204 can comprise a first portion 206 and a second portion 208 separated by a gap 210. A first laser 212 may act as a first light source to cause the first portion 206 of the photoconductive material 204 to become conductive when the first laser 212 is illuminated, and to be nonconductive otherwise. Similarly, a second laser 214 may act as a second light source to cause the second portion 208 of the photoconductive material 204 to become conductive when the second laser 214 is illuminated, and to be nonconductive otherwise. Either or both lasers may produce pulsed light or continuous wave (CW) light.

The substrate 200 may provide a waveguide 216 (e.g., a $SiN_x$ low-loss waveguide) to guide the light produced by the lasers 212, 214 to the first and second portions 206, 208 of the photoconductive material 204. The lower surface of the waveguide 216 may include a first grating 218 (e.g., a diffraction grating having a blaze angle of 45 degrees) for changing the direction of propagation of the light from the first laser 212 from being in the plane of the waveguide 216, to being perpendicular to the waveguide 216, e.g., propagating toward the first portion 206 of the photoconductive material 204. A second grating 220 can similarly direct propagation of the light from the second laser 214 to illuminate the second portion 208 of the photoconductive material 204.

It is understood that any suitable laser can be used to illuminate the photoconductive material 204. Example laser energy characteristics include a 980 nm InGaAs laser. In some embodiments the laser wavelength is 1310 nm or 1510 nm. U.S. Pat. No. 10,186,771, which is incorporated herein by reference, shows an example optically activated array using PICs including example photoconductive configurations.

In embodiments, a PIC 230 having the laser(s) 212, 214 and grating(s) 218, 220 can be built separately and adhered to the photoconductive substrate 200 via optical adhesives. In embodiments, edges, along with the back-side and top-side of the photoconductive material 204 and material edges include an IR mirror to contain the energy inside of the photoconductive material.

Figure 3:
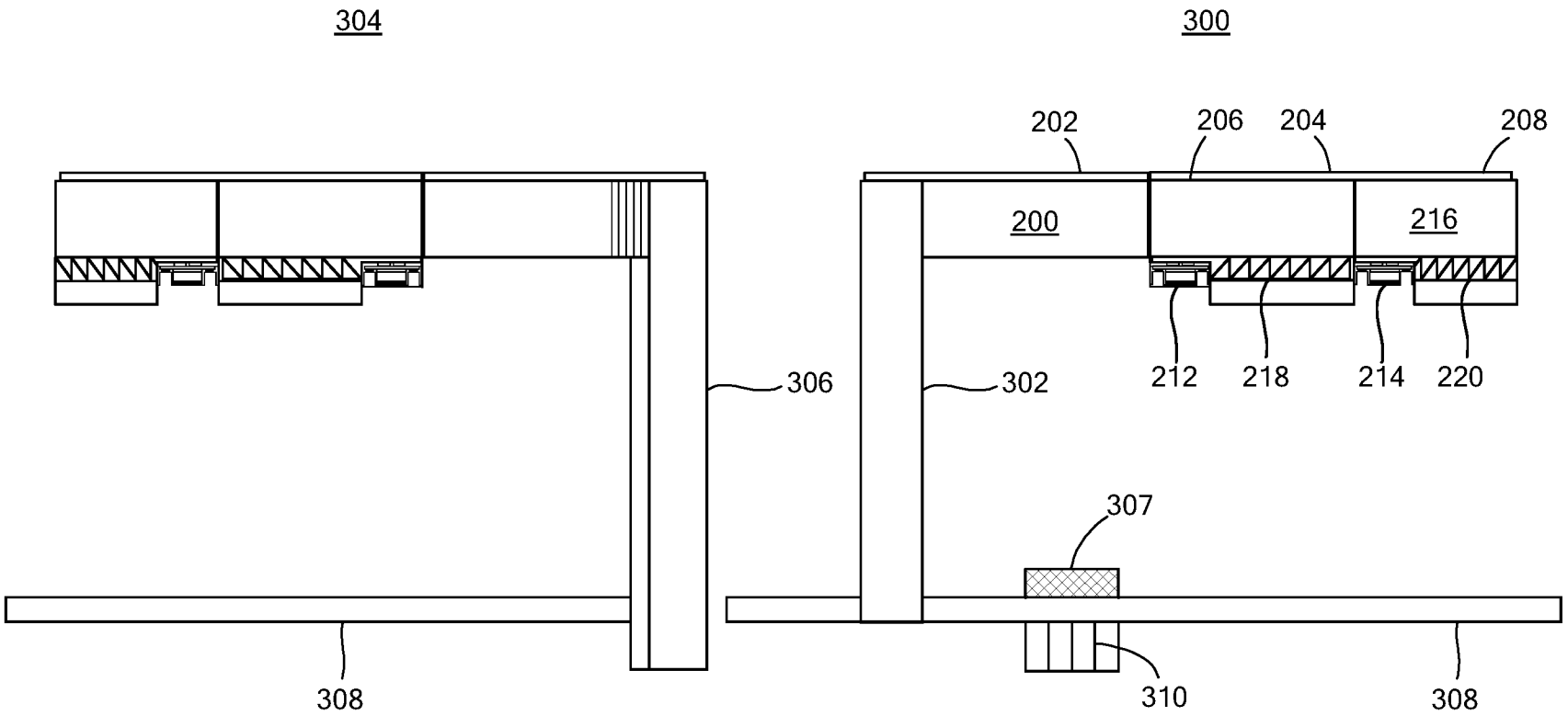
FIG. 3 is a cross sectional view of a portion of a dual spectrum tunable antenna system including the portion shown in FIG. 2.

FIG. 3 shows the sensor system elements of FIG. 2 along with an IR sensor. FIG. 3 can be seen as a side view of the sensor system of FIG. 1. A first RF antenna element 300 is coupled via a first feed line 302 to a feed circuit and a second RF antenna element 304, which may be similar to the first antenna element 300, is coupled via a second feed line 306 to the feed circuit. In an example embodiment, the IR detector 307 is located on a ground plane 308 and is positioned so that incoming energy is not blocked by the RF antenna elements 300 and 304. The IR detector 300 can include an IR interface 310 for providing a connection to a circuit for processing sensor information. In embodiments, the RF antenna can transmit and receive without interfering with the IR detector.

Figure 4A:
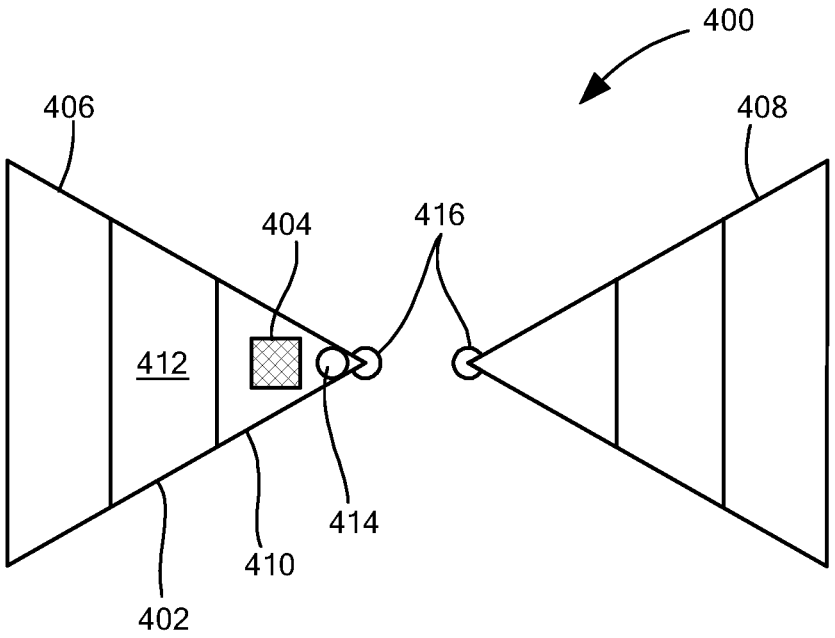
FIG. 4A is a top view of a dual spectrum tunable antenna aperture an IR sensor comprising a microbolometer.
Figure 4B:
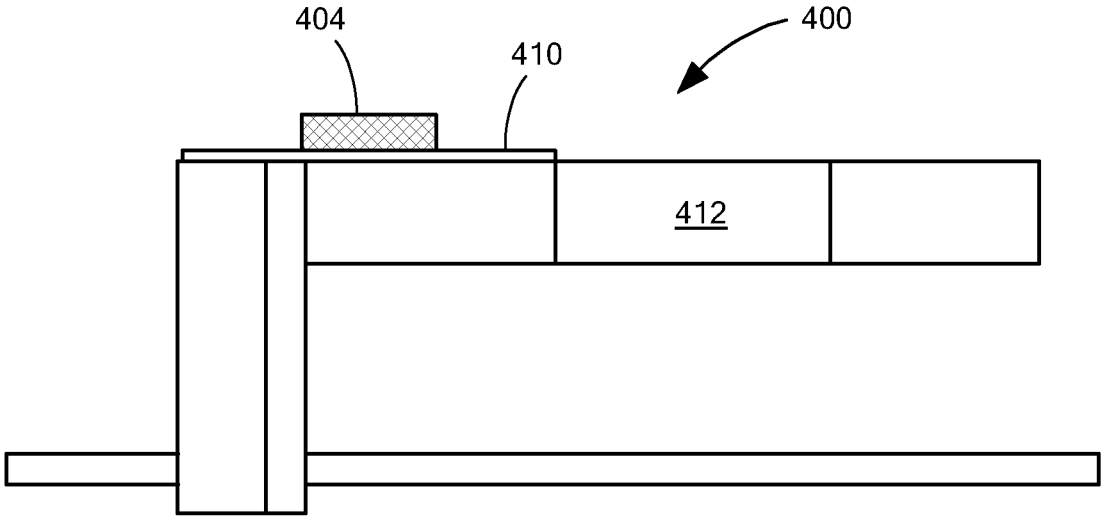
FIG. 4B is a side view of a dual spectrum tunable antenna aperture an IR sensor comprising a microbolometer.

FIGS. 4A and 4B show a sensor system 400 having an aperture with an RF antenna 402 and an IR detector 404. In the illustrated embodiment, the RF antenna 402 comprises a bowtie antenna having first and second elements 406, 408. The first and second elements 406 and 408 each comprise a conductive portion 410 and a photoconductive portion 412, as described above. The IR detector 404 is provided as a microbolometer on a surface of the first element 406. It is understood that a microbolometer is an uncooled thermal sensor having a series of pixels to detect infrared radiation where heat from absorbed energy changes the electrical resistance of the detector material. The microbolometer 404 can provide IR data 414 to an interface (not shown) for processing. A RF feed 416 can be coupled to the RF antenna elements 406, 408.

Figure 5B:
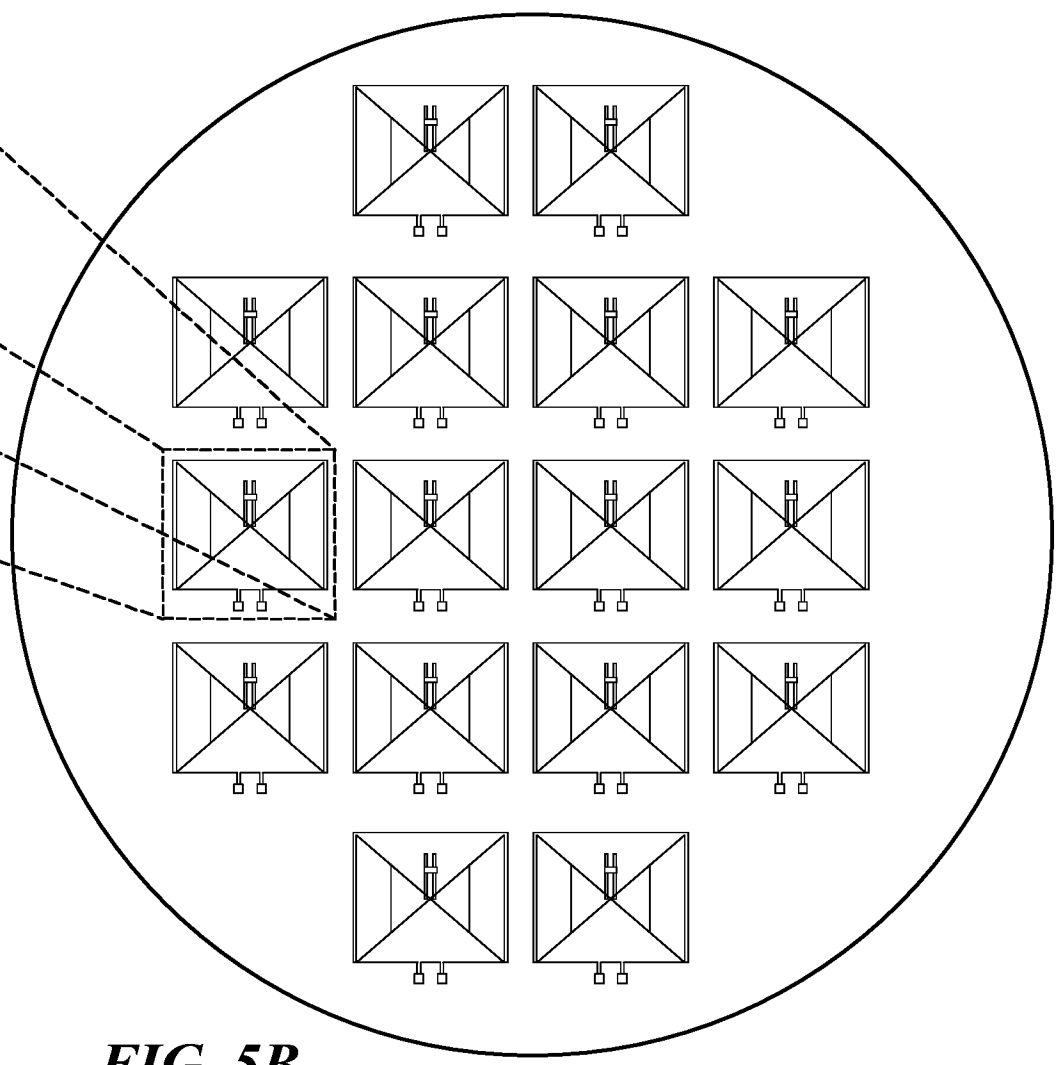
FIG. 5B a top view of a wafer including photonic integrated circuits (PICs) for tuning a dual spectrum antenna aperture.
Figure 5A:
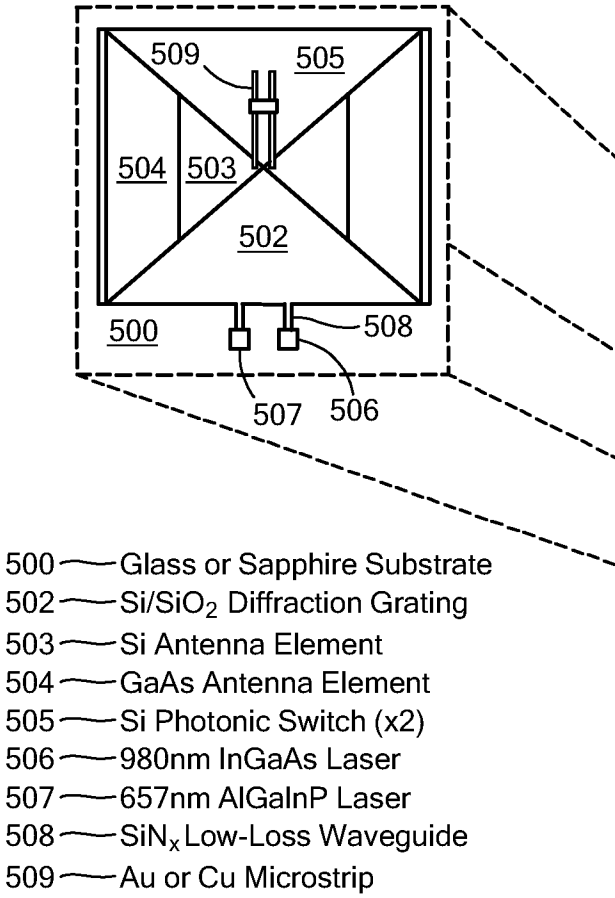
FIG. 5A is a top view of a photonic integrated circuit (PIC) for tuning a dual spectrum antenna aperture.

FIG. 5A shows an example PIC formed on a wafer shown in FIG. 5B. The tunable RF and IR aperture of FIG. 5A includes a substrate 500, which can comprise glass or sapphire, for example. A diffraction grating 502 can be formed using Si/SiO2 material for example. A first portion 503 of the RF antenna element can be formed over the diffraction grating 503. In the illustrated embodiment, the first portion 503 comprises a photoconductive material, such as Si. A second portion 504 of the RF antenna element also comprises a photoconductive material, such as GaAs. One or more photonic switches 505 can be coupled to a first laser 506, such as a 980 nm InGaAs laser, and a second laser 507, such as a 657 nm AlGaInP laser. A waveguide 508, such as SiNx, can be provided to guide the laser energy to the antenna elements. A connection, e.g., copper or microstrip, can be provided for the switches 505. In an example embodiment, the first portion 503 of the RF antenna element is conductive when either of the first laser 506 or the second laser 507 is active, e.g., the Si photoconductive material is conductive when the 657 nm or 980 nm laser is active. The second portion 504 of the RF antenna element is conductive only when the second laser 507 is active.

Embodiments provide a PIC for tuning a RF antenna where the PIC includes an integrated, uncooled laser, a grating, and waveguides to illuminate the photoconductive antenna element by attaching the PIC to the doped silicon substrate. The edges and opposite side of the silicon substrate can be coated with an IR micro-reflector. As optical efficiency increases, the performance of the PIC-enabled antenna approaches the same performance as an ideal metal antenna. In embodiments, frequency of operation is at least about 0.5 GHz to about 18 GHz RF.

Embodiments of the invention are applicable to a wide range of applications, such as planar and three-dimensional RF antenna structures, conformal arrays, infrared bugeye arrays, hemispheric arrays, sparse arrays, super resolution arrays, etc. Embodiments can provide polarization diversity and filter diversity and can be used as a tunable notch filter via the RF antenna characteristics to eliminate potential interference. The element as a unit cell allows for an element that can contain a SWIR, MWIR and LWIR element with the RF element. The RF element can be built out as a series of PIC tiles where the tiles can be fabricated as squares or rectangles and stacked to approach a linear edge. Embodiments may be useful as a real time tunable frequency selective surface (FSS) and to increase isolation between transmit and receive.

Focal plane arrays for the IR sensor can be mounted between RF elements so that appropriate optical elements can be included at the RF element layer to focus energy on the IR focal plane arrays. Microbolometer elements can be located on the metallic portion of the RF elements, for example. In embodiments, FPAs are mounted on the element ground plane with a focusing lens at the element or top aperture level that focuses energy down onto the FPAs. Microbolometers can be installed on the top layer and do not need to be cooled while FPAs may need to be cooled.

Phased array embodiments can include a PIC embodiment for one or one of each band of IR in the array. In other embodiments, elements can be placed on a hemisphere that allows each IR element to point in a different direction allowing for coverage over a full half hemisphere. Similar approaches can be taken with conformal arrays including leading wing edge arrays. The spreading of the infrared sensors over the remaining space of the other central element pieces can provide increased detection resolution similar to image processing since the infrared portion may not be scanned. Numerous other additional or improved capabilities can be determined such as use on satellites, ground vehicles, and ships.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

Elements of different embodiments described herein may be combined to form other embodiments not specifically set forth above. Various elements, which are described in the context of a single embodiment, may also be provided separately or in any suitable subcombination.

What is claimed is:

1. A system, comprising: an antenna aperture comprising: an RF antenna having first and second portions each configured to receive RF signals from free space and generate electrical signals in response to the received RF signals, wherein the first portion comprises a photoconductor material having a conductive state and a non-conductive state and the second portion comprises a metal material;

the system further including a PIC (photonic integrated circuit) for tuning the RF antenna by selecting the conductive state or the non-conductive state of the first portion of the RF antenna, wherein the PIC comprises a laser to selectively illuminate the first portion of the RF antenna and select the conductive state, wherein the PIC controls a size of the aperture by selecting the conductive state or the non-conductive state of the first portion of the RF antenna; and an IR sensor to detect IR energy.

2. The system according to claim 1, wherein the RF antenna comprises a frequency range of at least about 0.5 GHz to about 18 GHz.

3. The system according to claim 1, wherein the IR sensor is coincident with the RF antenna.

4. The system according to claim 1, wherein the IR sensor comprises a microbolometer.

5. The system according to claim 1, wherein the IR sensor comprises a focal plane array (FPA).

6. The system according to claim 1, wherein the IR sensor comprises a MWIR sensor.

7. The system according to claim 1, wherein the IR sensor comprises a SWIR sensor, a MWIR sensor, and a LWIR sensor.

8. The system according to claim 1, wherein the IR sensor is located between antenna elements of the RF antenna.

9. The system according to claim 1, further including a ground plane, wherein the IR sensor is located on the ground plane.

10. The system according to claim 9, further including a feed line from the RF antenna to the ground plane.

11. The system according to claim 1, wherein the aperture has a lower radar cross section when the first portion is in the non-conductive state.

12. The system according to claim 1, further including a PIC (photonic integrated circuit) adhered to a substrate supporting the RF antenna, wherein the PIC comprises at least one laser and at least one waveguide for tuning the RF antenna by selecting the conductive state or the non-conductive state of the first portion of the RF antenna.

13. A method, comprising: in an antenna aperture, controlling a conductive state of a photoconductive material for tuning an RF antenna, wherein the RF antenna includes first and second portions, wherein the first portion comprises the photoconductor material and the second portion comprises a metal material, and wherein each of the first and second portions of the RF antenna is configured to receive RF signals from free space and generate electrical signals in response to the received RF signals; the method further including employing a PIC (photonic integrated circuit) for tuning the RF antenna by selecting the conductive state or the non-conductive state of the first portion of the RF antenna, wherein the PIC comprises a laser to selectively illuminate the first portion of the RF antenna and select the conductive state, wherein the PIC controls a size of the aperture by selecting the conductive state or the non-conductive state of the first portion of the RF antenna; and employing an IR sensor to detect IR energy.

* * * * *